United States Patent [19]

Langensiepen et al.

[11] 4,452,370

[45] Jun. 5, 1984

[54] BOTTOM CLOSURE FOR CONTAINER

[75] Inventors: Gert Langensiepen; Werner Brüning, both of Engelskirchen, Fed. Rep. of Germany

[73] Assignee: Alfred Fischbach KG Kunststoff-Spritzgusswerk, Engelskirchen, Fed. Rep. of Germany

[21] Appl. No.: 447,629

[22] Filed: Dec. 6, 1982

[30] Foreign Application Priority Data

Dec. 8, 1981 [DE] Fed. Rep. of Germany ..... 3148490

[51] Int. Cl.[3] ..... B65D 83/00

[52] U.S. Cl. ..... 220/93; 92/242; 92/249; 222/386

[58] Field of Search ..... 220/93, 66; 222/386, 222/389, 386.5, 262, 263, 327; 92/242, 248, 249, 255

[56] References Cited

U.S. PATENT DOCUMENTS

| | | | |
|---|---|---|---|
| 2,433,506 | 12/1947 | Davis | 222/262 |
| 3,286,887 | 11/1966 | Sundolm | 222/386 |
| 3,381,863 | 5/1968 | Towns | 222/386.5 |
| 3,503,542 | 3/1970 | Ungerer . | |
| 3,815,791 | 6/1974 | Clark . | |
| 4,027,810 | 6/1977 | van Manen . | |
| 4,030,643 | 6/1977 | van Manen | 222/386 |

FOREIGN PATENT DOCUMENTS

| | | | |
|---|---|---|---|
| 0004100 | 9/1979 | European Pat. Off. . | |
| 1272816 | 7/1968 | Fed. Rep. of Germany . | |
| 2034047 | 8/1971 | Fed. Rep. of Germany | 222/386 |
| 2217071 | 1/1974 | Fed. Rep. of Germany . | |
| 2920915 | 11/1980 | Fed. Rep. of Germany | 222/386 |
| 514787 | 11/1939 | United Kingdom | 222/386 |

*Primary Examiner*—Allan N. Shoap

*Attorney, Agent, or Firm*—Michael J. Striker

[57] ABSTRACT

A piston-shaped bottom closure for a hollow container has a closing member arranged so that when the closure is inserted into a container the closing member extends transversely of an inner wall of the container, a hollow guiding member extending from the closing member in an axial direction so that in the inserted condition of the closure the guiding member is guided by the inner wall of the container, at least one sealing lip provided on the guiding member and abutting against the inner wall of the container in the inserted condition of the closure, and a cover member arranged on the closing member at its side facing toward a storage chamber of the container and having a contour substantially corresponding to the contour of the closing member, wherein the cover is composed of a material having a different elasticity than the closing and guiding members and the sealing lip and is provided with an edge which extends towards the guiding member and overlaps an outer edge of the closing member so as to be arrested on the closing member in the axial direction.

4 Claims, 4 Drawing Figures

BOTTOM CLOSURE FOR CONTAINER

BACKGROUND OF THE INVENTION

The present invention relates to a bottom closure for a container. More particularly, it relates to a bottom closure of elastic material, which is utilized as a pushing piston for viscous mass for a hollow cylindrical extrusion container, particularly for a cartridge.

Bottom closures of the above mentioned general type are known in the art. A known bottom closure has a closing disk located adjacent to the storage chamber of the container, and a hollow guiding portion extending from the closing disk toward a filling opening of the container and provided with at least one elastic lip which surrounds this hollow guiding portion and abuts against the inner wall of the container. When extrusion containers or cartridges are filled with permanently elastic, permanently plastic, hardenable and other similar paste-like materials, particularly filling masses, it is necessary to utilize the above mentioned pushing pistons which serve simultaneously as bottom closures of the containers before the utilization of the plastic masses. Such bottom closures are described, for example, in the German Pat. No. 2,034,047 and in the German Offenlegungsschrift No. 3,005,855 which corresponds to U.S. patent application Ser. No. 227,410. The above mentioned bottom closures are composed of a maximum elastic synthetic plastic material for providing the elasticity required for all functions of the bottom closures, for example of polyethylene or polypropylene. In practice, it has been recognized that such specially elastic synthetic plastic materials have a relatively high gas and water vapor permeability. However, it is frequently required to fill the extrusion containers, and particularly cartridges with masses which contain volatile components, particularly solvents. In the event of the above mentioned gas permeability, these components can diffuse through the walls of the piston, so that the required tightness of the bottom closure, particularly over long storage times for such masses, is not guaranteed, and these masses gradually experience not acceptable changes, for example premature hardening. When instead of the above mentioned highly elastic synthetic plastic materials, other synthetic plastic materials are utilized which have the required gas diffusion tightness, it has been recognized that these synthetic plastic materials simultaneously have such an increased hardness and rigidity that the elasticity required for functioning of the bottom closures and pushing pistons is not guaranteed. In other words, the ventilating function during insertion of the bottom closure, and stripping and sealing action during loading of the bottom closure as a pushing piston, are not provided.

SUMMARY OF THE INVENTION

Accordingly, it is an object of the present invention to provide a bottom closure for containers which avoids the disadvantages of the prior art.

More particularly, it is an object of the present invention to provide a bottom closure for containers, which simultaneously guarantees the elasticity required for operation of the bottom closure, on the one hand, and, on the other hand, the required strength and diffusion tightness at its faces facing toward the storage chamber of the container.

It is also an object of the present invention to provide these properties with a construction which is favorable for deformation of synthetic plastic material and to attain all functions required for the bottom closure.

A further object of the present invention is to provide a bottom closure which can be used universally also for masses which produce aggressive or volatile components, and also can be used with different types of loading of the bottom closure with functioning as a pushing piston.

In keeping with these objects, and with others which will become apparent hereinafter, one feature of the present invention resides, briefly stated, in a piston-shaped bottom closure for a hollow container which is provided with a cover member arranged on a closing member at its side facing toward a storage member of the container and having a contour substantially corresponding to the contour of the closing member, and the cover member is composed of a material which has a different elasticity than the elasticity of the closing and guiding members and the sealing lip of the closure, and also the cover member has an edge which extends toward the guiding member and overlaps an outer edge of the closing member so as to be arrested on the closing member in an axial direction.

When the bottom closure is designed in accordance with the present invention, the whole bottom closure with the exception of the cover member can be composed of an elastic synthetic plastic material which completely guarantees the functions of the bottom closure, whereas its front part facing toward the mass and its components is composed of such a material which has the required strength and diffusion tightness against the mass stored in the storage chamber.

The cover member and the remaining parts of the bottom closure with the closing member, the guiding member, and the sealing lip or lips can be formed as simple structural parts of respective materials or plastic. In the event that they are composed of synthetic plastic materials, they can be injection-molded and after fitting of the cover member onto the closing member easily and simply connected with one another. The edges which lie against one another guarantee the required arresting of the cover element in the longitudinal or axial direction of the bottom closure. The cover element can be composed of a suitable synthetic plastic material or a metallic material, for example aluminum or alloy.

The bottom closure in accordance with the present invention can be provided at its inner side with an annular abutment and an extending annular lip corresponding to those disclosed in the German Pat. No. 2,034,047, and also with sealing lips corresponding to those provided in the German Offenlegungsschrift No. 3,005,855 or U.S. patent application Ser. No. 227,410. When the bottom closure operates as a pushing piston with a mechanical piston, the outer edge of the cover member provides for the action of a front pushing lip or stripping and sealing action. When the bottom closure is loaded as a pushing piston with the aid of a pressure medium, the sealing lip provides at the periphery of the guiding member the required tightness.

The simple cover element which is used in the bottom closure in accordance with the present invention provides for extraordinary possibilities for the utilization of the bottom closure and its capability of performing all functions corresponding to the properties of the enclosed masses because it guarantees reliable sealing of the storage chamber of the extrusion container. In practice, regardless of the construction of the bottom closure, the synthetic plastic material of the cover element can be selected to satisfy the requirements of the enclosed masses, particularly it can be manufactured of a gas diffusion tight synthetic plastic material.

In accordance with another feature of the present invention, the cover member is composed of a material which is stiffer than the material of the remaining portion of the bottom closure, that is the closing member, the guiding member, and the sealing lip or lips. More particularly, the cover member is composed of a stiffer synthetic plastic material. In this case, the remaining portion of the bottom closure can be selected with an especially high elasticity to guarantee the above described functions, and the closing member, because of its stiffness, can be reliably used as closing and stripping member of the bottom closure or pushing piston. When the bottom closure is designed in accordance with this feature, it provides for the following, especially advantageous results: In the event of use in the extrusion container, after front loading of the bottom closure as a pushing piston, the loading is interrupted, in the known bottom closures an undesirable post-running of the pressed mass takes place as a rule, because as a result of the yieldability a pressure is built up inside the extrusion container. When the bottom closure is designed in accordance with the above mentioned feature of the invention, it has been found that after removal of the working pressure from the bottom closure a pressure formed in the extrusion container by the rearward deflection of the highly elastic bottom closure part in the event of the stiff cover member can decrease. Thereby the disadvantageous post-running of the mass is prevented.

In accordance with a further feature of the present invention, which is especially advantageous for mounting and handling of the bottom closure, the surrounding edge of the cover member and the outer edge of the closing member are formed complementary to one another so that the edge of the cover member engages behind the outer edge of the closing member in a snap-locking manner. Assembly of the cover member with the closing and guiding member is thereby possible in a very simple manner with simultaneous reliable arresting of the cover member on the edge of the closing member. Thus, both structural parts of the bottom closure are designed in a simple way and can be easily manufactured of the respective synthetic plastic material.

For many applications, it is especially advantageous when, in accordance with still a further feature of the present invention, the cover member is composed of polyamide and the remaining portion of the bottom closure, such as the closing member, the guiding member and the sealing lip or lips, is composed of polyethylene or polypropylene. The polyamide of the cover member has a chemical strength and especially a high gas diffusion tightness, whereas the polyethylene or polypropylene guarantee high working elasticity for the remaining portion of the bottom closure.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 2:
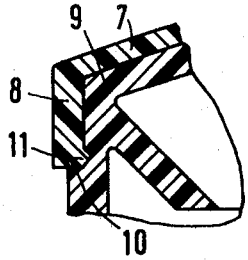
FIG. 2 is a view showing a portion of the inventive bottom closure in the region of an edge between closing and cover members, on an enlarged scale.

A bottom closure shown in the drawing has a closing member which is identified by reference numeral 1. The closing member 1 faces toward a storage chamber of an extrusion container and is convex in direction toward the storage chamber. The bottom closure further has a hollow guiding member 2 extending from the closing member 1 toward a filling opening of the extrusion container 3 and guided on an inner wall of the latter, as can be seen from FIGS. 3 and 4. Elastic sealing lips 4 are provided on the guiding portion 2 and surround the outer wall of the latter. The sealing lips 4 are formed as disclosed, for example, in the German Offenlegungsschrift No. 3,005,855 or the U.S. patent application Ser. No. 227,410.

Inside the guiding member 2 and directly near the point of connection of the latter with the closing member 1, an annular lip 5 is provided and extends toward the open side of the guiding portion. The closing member 1 has at its wall located inside the guiding member 2, an annular abutment 6 which also extends toward the open end of the guiding member behind the annular lip 5.

The above described parts of the bottom closure which are identified by reference numerals 1–6 are formed as a one-piece element composed of an elastic synthetic plastic material. More particularly, this one-piece element can be composed of polyethylene or polypropylene.

A cover member 7 is arranged on the closing member 1 and more particularly at its side facing toward the storage chamber of the container. The cover member 7 is formed so as to follow the contour of the closing member 1. The cover member 7 has a circular edge 8 which extends toward the guiding member 2 and engages over an outer edge 9 of the closing member 1 so as to be arrested in the longitudinal direction on the latter. For providing this arresting, the circular edge 8 of the cover member 7 and the outer edge 9 of the closing element 1 are formed complementary to one another, and the edge 8 of the cover member engages behind the edge 9 of the closing member in a snap-locking manner. As can be seen particularly from FIG. 2, for this purpose the outer edge 9 of the locking member 1 has a circular annular groove 10, and the edge 8 of the cover member 7 has an inwardly extending projection 11 which snaps into the groove 10 during fitting of the cover member 7 onto the closing member 1.

The cover member 7 is formed as a one-piece element of such a material whose properties are selected in correspondence with a mass to be accommodated in the extrusion container. More particularly, a synthetic plastic material with gas diffusion tightness and chemical resistance is selected, which also has a higher stiffness than the synthetic plastic material of the remaining portion of the closure member, including the parts 1–6 with sufficient elasticity. For example, the cover member 7 with its edge 8 can be composed of polyamide, particularly when the parts 1–6 of the bottom closure are composed of polyethylene or polypropylene.

Figure 1:
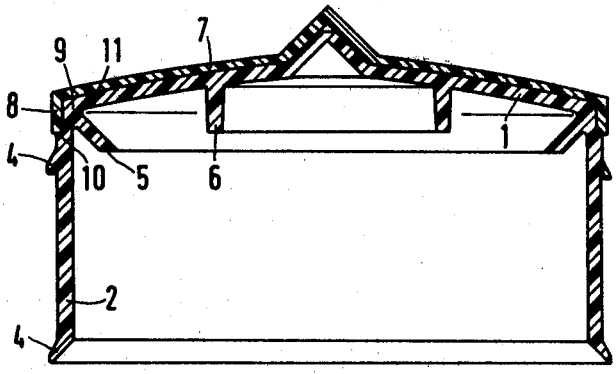
FIG. 1 is a view showing a longitudinal section of a bottom closure in accordance with the present invention.
Figure 3:
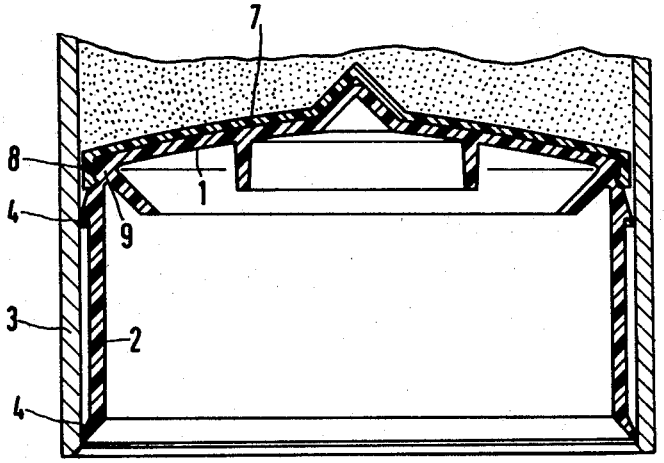
FIG. 3 is a view showing a longitudinal section of an extrusion container with the inserted bottom closure in accordance with the present invention.
Figure 4:
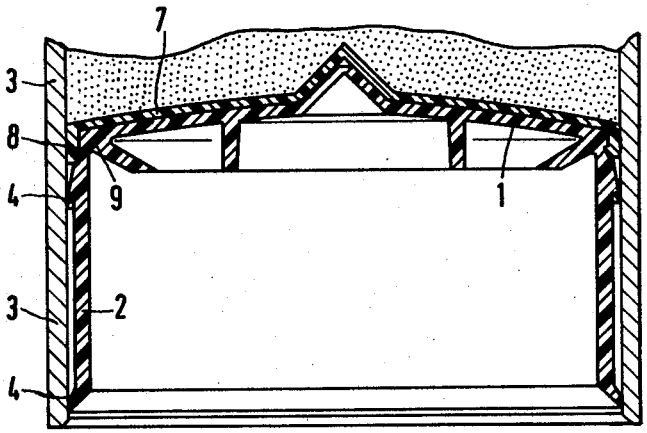
FIG. 4 is a view substantially corresponding to the view of FIG. 3, and showing the bottom closure in the event that it is loaded for pressing of a mass in the container.

When the bottom closure shown in FIG. 1 is inserted into the extrusion container 3 after filling of the latter, air entrapped in the container can pass in a sufficient degree outwardly of the edge of the cover member 7 and over the elastically deformable sealing lip 4. This situation is shown in FIG. 3 in the rear region of the extrusion container 3. When the bottom closure is mechanically acted upon by a suitable displacement element, the annular lip 5 is pressed back as shown in FIG. 4. Thus, the displacing pusher or the like abuts against the annular abutment 6, the outer edge 9 of the closing element 1 is expanded and the outer edge 8 of the cover member 7 abuts against the inner wall of the extrusion container 3. Thereby the outer edge 8 of the cover member 7 performs the functions of stripping and tightening during further displacement of the bottom closure or pushing piston, similarly to pushing lips used for this purpose. This situation is shown in FIG. 4.

When the bottom closure or pushing piston is acted upon by a pressure medium for its displacement, the sealing lips 4 provide, because of their expansion, the required sealing functions, and the outer edge 8 of the cover member 7 can also perform the stripping functions. When the bottom closure or pushing piston is unloaded, the more elastic part of the bottom closure can be deflected back so that reduction of the pressure available in the extrusion container takes place, and thereby a post-running of the mass is prevented.

The wall thickness of the parts 1–6 of the bottom closure and of the cover member 7, 8 can be so selected relative to one another, that the respective stiffness or elasticity for the operational action can be attained. More particularly, the wall thickness of the cover member 7 can be selected so thin that the above described expanding action under mechanical loading can be obtained.

The shape of the closing member 1, the guiding member 2, and the sealing lips 4, as well as their number and the material of these parts, can be selected in correspondence with the desired ventilation and tightness actions and in correspondence with the design and dimensions of the extrusion container, as well as in dependence upon the mass to be filled. The shape and the material of the cover member can also be selected correspondingly. By the design and material pair, the bottom closure in accordance with the present invention can be universally adapted for respective application cases.

It will be understood that each of the elements described above, or two or more together, may also find a useful application in other types of constructions differing from the types described above.

While the invention has been illustrated and described as embodied in a bottom closure for containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A piston-shaped bottom closure for a hollow container having a filling opening and an inner wall bounding a storage chamber for a plastic mass, the closure comprising a closing member having an axis and arranged so that when the closure is inserted into a container said closing member extends transversely to a tubular inner wall of the container and has an outer side facing toward a storage chamber of the latter, said closing member having a tubular extension with an outer edge portion, said outer side having a contour convexly-shaped in the direction towards the storage chamber at said outer side, said tubular extension extending from the outer periphery of said outer side in a direction opposite said contour; a hollow, tubular guiding member extending from said tubular extension of said closing member in an axial direction and arranged so that in the inserted condition of the closure said guiding member is guided by the inner wall of the container; at least one sealing lip provided on said guiding member and arranged to abut against the inner wall of the container in the inserted condition of the closure, said closing and guiding members and said sealing lip being composed of a material having a predetermined elasticity; and a cover member arranged on said outer side of said closure member and having a contour substantially corresponding to the contour of the latter, said cover member being composed of a material having a different elasticity than said closing and guiding members and said sealing lip and being provided with a tubular extension having an edge portion which extends toward said guiding member and overlaps said outer edge portion of said closing member so as to be arrested on the latter in said axial direction, said edge portion of said cover member and said outer edge portion of said closing member having means for snap-locking one behind the other, said cover member together with said edge being composed of an elastic material which is stiffer than the material of said closing and guiding members.

2. A bottom closure as defined in claim 1, wherein said closing and guiding members are composed of a synthetic plastic material and said cover member together with said edge portion being composed of a synthetic plastic material.

3. A bottom closure as defined in claim 1, wherein said cover member together with said edge portion is composed of polyamide, said closing and guiding members being composed of polyethylene.

4. A bottom closure as defined in claim 1, wherein said cover member together with said edge portion is composed of polyamide, said closing and guiding members being composed of polypropylene.

* * * * *